US006252483B1

(12) United States Patent
Kawano et al.

(10) Patent No.: US 6,252,483 B1
(45) Date of Patent: Jun. 26, 2001

(54) SLANT WINDING ELECTROMAGNETIC COIL AND IGNITION COIL FOR INTERNAL COMBUSTION ENGINE USING SAME

(75) Inventors: Keisuke Kawano, Kariya; Kazutoyo Oosuka, Aichi-ken; Masami Kojima, Chiryu; Akimitsu Sugiura, Takahama; Yoshitaka Satou, Toyohashi; Katsumi Nakazawa, Kariya, all of (JP)

(73) Assignee: Nippondenso Co., Ltd., Kariya (JP)

( * ) Notice: Subject to any disclaimer, the term of this patent is extended or adjusted under 35 U.S.C. 154(b) by 0 days.

(21) Appl. No.: 09/460,733

(22) Filed: Dec. 14, 1999

Related U.S. Application Data

(62) Division of application No. 08/696,560, filed on Aug. 16, 1996, now Pat. No. 6,060,973.

(30) Foreign Application Priority Data

| | | |
|---|---|---|
| Aug. 25, 1995 | (JP) | 7-217928 |
| Oct. 30, 1995 | (JP) | 7-281698 |
| Jul. 19, 1996 | (JP) | 8-190546 |

(51) Int. Cl.[7] ..... H01F 27/28
(52) U.S. Cl. ..... 336/189; 336/190; 336/222
(58) Field of Search ..... 336/70, 198, 182, 336/189, 190, 191, 222; 242/174

(56) References Cited

U.S. PATENT DOCUMENTS

| | | | |
|---|---|---|---|
| 4,005,567 | | 2/1977 | Mariani . |
| 4,639,706 | | 1/1987 | Shimizu . |
| 4,739,947 | * | 4/1988 | Anseel et al. ..... 242/176 |
| 4,808,959 | | 2/1989 | Weissman . |
| 5,062,580 | | 11/1991 | Meagher . |
| 5,255,836 | | 10/1993 | Horndler . |

FOREIGN PATENT DOCUMENTS

| | | | |
|---|---|---|---|
| 145675 | * | 6/1919 | (DE) ..... 336/70 |
| 254093 | | 12/1948 | (DE) . |
| 28 29 943 | | 1/1980 | (DE) . |
| 42 08 706 | | 9/1993 | (DE) . |
| 196451 | | 3/1938 | (EP) . |
| 0 142 175 | | 5/1985 | (EP) . |
| 0 518 737 A1 | | 12/1992 | (EP) . |
| 501830 | | 3/1939 | (GB) . |
| 59-010218 | | 1/1984 | (JP) . |
| 60-107813 | | 6/1985 | (JP) . |
| 2-106910 | | 4/1990 | (JP) . |
| 2-151008 | | 6/1990 | (JP) . |
| 2-156513 | | 6/1990 | (JP) . |
| 6-027922 | | 7/1994 | (JP) . |

* cited by examiner

*Primary Examiner*—Anh Mai
(74) *Attorney, Agent, or Firm*—Pillsbury Winthrop LLP

(57) ABSTRACT

An electromagnetic coil which may be employed as an ignition coil for an internal combustion engine is disclosed. The electromagnetic coil includes a lower voltage winding portion and a higher voltage winding portion. The lower voltage winding portion is wound around a spool and includes a plurality of winding layers overlapped with each other and inclined at a given angle to the length of the spool. Each of the winding layers includes a collection of turns made up of a leading portion of wire. The higher voltage winding portion is wound around the spool adjacent the lower voltage winding portion and includes a plurality of winding layers overlapped with each other and inclined at a given angle to the length of the spool. Each of the winding layers includes a collection of turns made up of a trailing portion of the wire.

10 Claims, 8 Drawing Sheets

SLANT WINDING ELECTROMAGNETIC COIL AND IGNITION COIL FOR INTERNAL COMBUSTION ENGINE USING SAME

This is a division of application Ser. No. 08/696,560, filed Aug. 16. 1996 now U.S. Pat. No. 6,060,973.

BACKGROUND OF THE INVENTION

1. Technical Field

The present invention relates generally to an electromagnetic coil suitable for use under application of high voltage, and more particularly to an ignition coil which develops high voltage to produce a spark as for ignition purposes in an internal combustion engine.

2. Background of Related Art

Japanese Patent Second Publication No. 2-18572 and Japanese Patent First Publication Nos. 2-106910 and 60-107813 teach conventional electromagnetic coils. These electromagnetic coils are made up of a plurality of slant winding layers oriented at a given angle to the length of a spool so that each of the slant winding layers presents a circular cone. In the following discussion, this type of electromagnetic coil will be referred to as a slant winding electromagnetic coil. The slant winding electromagnetic coils may be distinguished in the shape of winding layers from typical electromagnetic coils made up of cylindrical winding layers each extending in a lengthwise direction of a bobbin.

In such a slant winding electromagnetic coil, since each winding layer, as discussed above, extends radially so as to form a circular cone, the number of turns thereof is smaller than that of each of the cylindrical winding layers. This means that it is possible to decrease the number of turns of adjacent two of the winding layers to decrease a potential difference between the adjacent winding layers, thereby avoiding the dielectric breakdown for realizing an electromagnetic coil suitable for use under application of high voltage.

Such an electromagnetic coil is, as discussed in the above publications, suitable for use in an ignition coil for internal combustion engines. Particularly, this type of electromagnetic coil may be employed as a secondary winding for developing high voltage in combination with a primary winding.

The results of tests performed by the inventors of this application, however, showed that it was very difficult to arrange slant winding layers on a spool perfectly in an industrial manufacturing process, especially because an automatic winding machine which makes coils at high speeds is usually used in the industrial manufacturing process, and it is necessary to use thin wire for achieving the compact and lightweight structure of a coil.

The slant winding requires the formation of a cone-shaped winding using a leading portion of wire to define a reference surface for arranging slant winding layers in a lengthwise direction of a spool. In order to form the cone-shaped winding easily, it is useful to make an irregular winding of a triangle shape in cross section using a leading portion of wire, but a drawback is encountered in that it is difficult to develop a potential difference across each turn of the irregular winding at a constant level.

In the slant winding process, winding layers made of a trailing portion of wire may be shifted or crumbled.

The turns of wire may be disordered at the end of winding due to a variation in length of a spool, a variation in tensile force acting on the wire during winding, or undesirable insertion of a portion of the wire into a groove formed in a flange provided at an end of the spool for withdrawing an end of the wire.

When the above discussed irregular winding or irregularity of the winding caused by the disorder of the turns is included in the slant winding layers, it may cause some of the turns creating high voltages to be arranged adjacent to each other. It thus becomes difficult to estimate and manage the potential difference between the turns so that it is difficult to achieve high insulation expected in the slant winding electromagnetic coils.

SUMMARY OF THE INVENTION

It is therefore a principal object of the present invention to avoid the disadvantages of the prior art.

According to one aspect of the present invention, there is provided an electromagnetic coil which comprises a winding member having a given length; a lower voltage winding portion wound around a first length of the winding member, the lower voltage winding portion including a plurality of winding layers overlapped with each other and inclined at a given angle to the first length of the winding member, each of the winding layers being made up of a collection of turns of wire; a higher voltage winding portion wound around a second length of the winding member continuing from the first length, the high voltage winding portion including a plurality of winding layers overlapped with each other and inclined at a given angle to the second length of the winding member, each of the winding layers being made up of a collection of turns of the wire so that an arrangement of the collection of the turns of the wire of the higher voltage winding portion is more regular than that of the lower voltage winding portion.

In the preferred mode of the invention, the turns of the wire of each of the winding layers of the lower voltage winding portion and the higher voltage winding portion are arranged coaxially with each other. The coaxial arrangement of the collection of the turns of the higher voltage winding portion is more regular than that of the lower voltage winding portion.

The lower voltage winding portion includes an irregular winding made up of turns of the wire arranged irregularly.

According to another aspect of the invention, there is provided an electromagnetic coil which comprises a winding member having a given length; a lower voltage winding portion wound around a first length of the winding member, the lower voltage winding portion including a plurality of winding layers overlapped with each other and inclined at a given angle to the first length of the winding member, each of the winding layers of the lower voltage winding portion including a collection of turns made up of a leading portion of wire; and a higher voltage winding portion wound around a second length of the winding member, the high voltage winding portion including a plurality of winding layers overlapped with each other and inclined at a given angle to the second length of the winding member continuing from the first length, each of the winding layers including a collection of turns made up of a trailing portion of the wire.

In the preferred mode of the invention, the winding layers of the lower voltage winding portion and the higher voltage winding portion is arranged long the length of the winding member so as to define a conical surface tapered decreased in diameter as reaching from the lower voltage winding portion to the higher voltage winding portion.

An irregular winding portion is further provided in the lower voltage winding portion, which is formed with turns of the wire wound irregularly.

The electromagnetic coil is a secondary winding of an ignition coil for an internal combustion engine.

The electromagnetic coil is a high voltage developing coil which develops a high voltage through electromagnetic induction. The higher voltage winding portion includes adjacent two of the winding layers which have the number of turns $t_H$ given by the following equation:

$$t_H \leq n_T / V_{OUT} \times 180$$

where $n_T$ is a total number of turns of the lower and higher winding portions, and $V_{OUT}$ is an output voltage outputted by the electromagnetic coil.

The higher voltage winding portion is smaller in diameter than the lower voltage winding portion.

The higher voltage winding portion may be decreased in diameter than the lower voltage winding portion at a given rate.

The winding member is formed with a spool having formed at an end thereof a flange which has a tapered surface engaging the higher voltage winding portion.

The tapered surface of the flange is oriented at an obtuse angle to a longitudinal center line of the spool.

The flange of the spool has formed therein an opening through which the trailing portion of the wire passes. The opening is located in a radial direction of the spool above an outer peripheral portion of an end of the higher voltage winding portion engaging the flange.

The opening is formed with a groove extending inward from an outer peripheral portion of the flange.

According to a further aspect of the invention, there is provided an electromagnetic coil which comprises: a spool having a given length, the spool including a wider slot and a narrower slot; a lower voltage winding portion wound around the wider slot of the spool, the lower voltage winding portion including a plurality of winding layers overlapped with each other and inclined at a given angle to the length of the spool, the winding layers including a collection of turns made of a leading portion of wire, respectively; and a higher voltage winding portion wound around the narrower slot of the spool, the high voltage winding portion including a collection of turns made of a trailing portion of the wire.

According to a further aspect of the invention, there is provided an electromagnetic coil which comprises: a lower voltage winding portion having a first length, including a plurality of winding layers overlapped with each other and inclined at a given angle to the first length; and a higher voltage winding portion having a second length, including a plurality of winding layers overlapped with each other and inclined at a given angle to the second length, the higher voltage winding portion including adjacent two of the winding layers which have the number of turns $t_H$ given by the following equation:

$$t_H \leq n_T / V_{OUT} \times 180$$

where $n_T$ is a total number of turns of the lower and higher winding portions, and $V_{OUT}$ is an output voltage outputted by the electromagnetic coil.

In the preferred mode of the invention, the adjacent two of the winding layers of the higher voltage winding portion has the number of turns $t_H$ given by the following equation:

$$t_H \leq n_T / V_{OUT} \times 100$$

The diameter of the higher voltage winding portion is greater than that of the lower voltage winding portion.

The number of turns of each of the winding layers of the higher voltage winding portion is smaller than that of the lower voltage winding portion.

The diameter of each of the winding layers of the lower voltage winding portion and the higher voltage winding portion is decreased at a given rate from the lower voltage winding portion to the higher voltage winding portion.

The winding layers of the lower voltage winding portion and the higher voltage winding portion are arranged so as to define a tapered profile.

A profile defined by the winding layers of the lower voltage winding portion and the higher voltage winding portion is changed in a stepwise fashion.

The electromagnetic coil is a secondary winding of an ignition coil for an internal combustion engine.

According to a still further aspect of the invention, there is provided an electromagnetic coil which comprises: a lower voltage winding portion having a first length, including a plurality of winding layers overlapped with each other and inclined at a given angle to the first length; and a higher voltage winding portion having a second length, including a plurality of winding layers overlapped with each other and inclined at a given angle to the second length, the higher voltage winding portion having a diameter smaller than that of the lower voltage winding portion.

In the preferred mode of the invention, the number of turns of each of the winding layers of the higher voltage winding portion is smaller than that of the lower voltage winding portion.

The diameter of each of the winding layers of the lower voltage winding portion and the higher voltage winding portion is decreased at a given rate from the lower voltage winding portion to the higher voltage winding portion.

The electromagnetic coil is a secondary winding of an ignition coil for an internal combustion engine.

According to a yet further aspect of the invention, there is provided an electromagnetic coil which comprises: a spool having a given length, the spool including a wider slot and a narrower slot;

a lower voltage winding portion wound around the wider slot of the spool, the lower voltage winding portion including a plurality of winding layers overlapped with each other and inclined at a given angle to the length of the spool; and a higher voltage winding portion wound around the narrower slot of the spool.

In the preferred mode of the invention, the electromagnetic coil is a secondary winding of an ignition coil for an internal combustion engine.

According to a further aspect of the invention, there is provided an electromagnetic coil which comprises: a spool having a given length; a winding portion wound around the length of the spool, the winding portion including a plurality of winding layers overlapped with each other and inclined at a given angle to the length of the spool; and a flange portion formed on the spool, the flange portion having a surface engaging one of the winding layers arranged at the end of winding, oriented to the length of the spool at an obtuse angle.

According to a further aspect of the invention, there is provided an electromagnetic coil which comprises: a spool having a given length; a winding portion including a wire wound around the length of the spool, the winding portion including a plurality of winding layers overlapped with each other and inclined at a given angle to the length of the spool; a flange portion formed on a winding end side of the spool; an opening formed in the flange for withdrawing an end of the wire from the spool, the opening being located in a radial direction of the spool above an outer peripheral portion of an end of the winding layers of the winding portion engaging the flange.

In the preferred mode of the invention, the opening is formed with a groove extending inward from an outer peripheral portion of the flange.

The electromagnetic coil is a secondary winding of an ignition coil for an internal combustion engine.

BRIEF DESCRIPTION OF THE DRAWINGS

The present invention will be understood more fully from the detailed description given hereinbelow and from the accompanying drawings of the preferred embodiment of the invention, which, however, should not be taken to limit the invention to the specific embodiment but are for explanation and understanding only.

In the drawings.

DESCRIPTION OF THE PREFERRED EMBODIMENT

Figure 1:
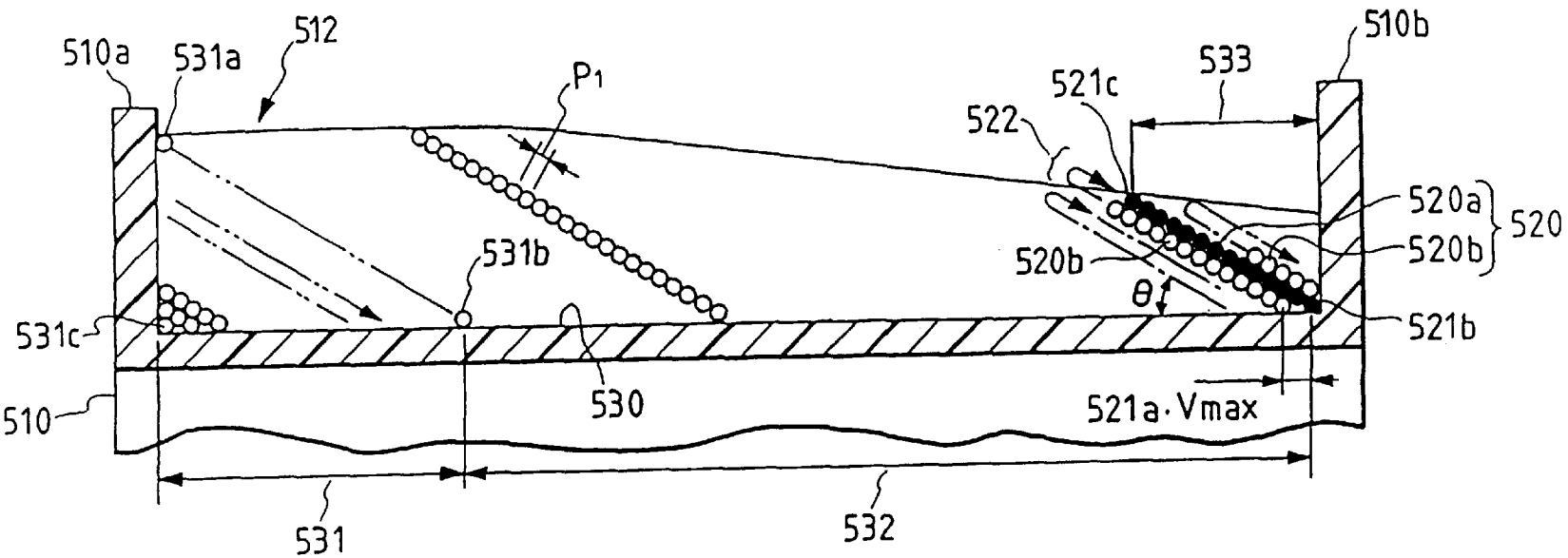
FIG. 1 is a cross sectional view which shows a secondary winding of an electromagnetic coil according to the present invention.
Figure 2:
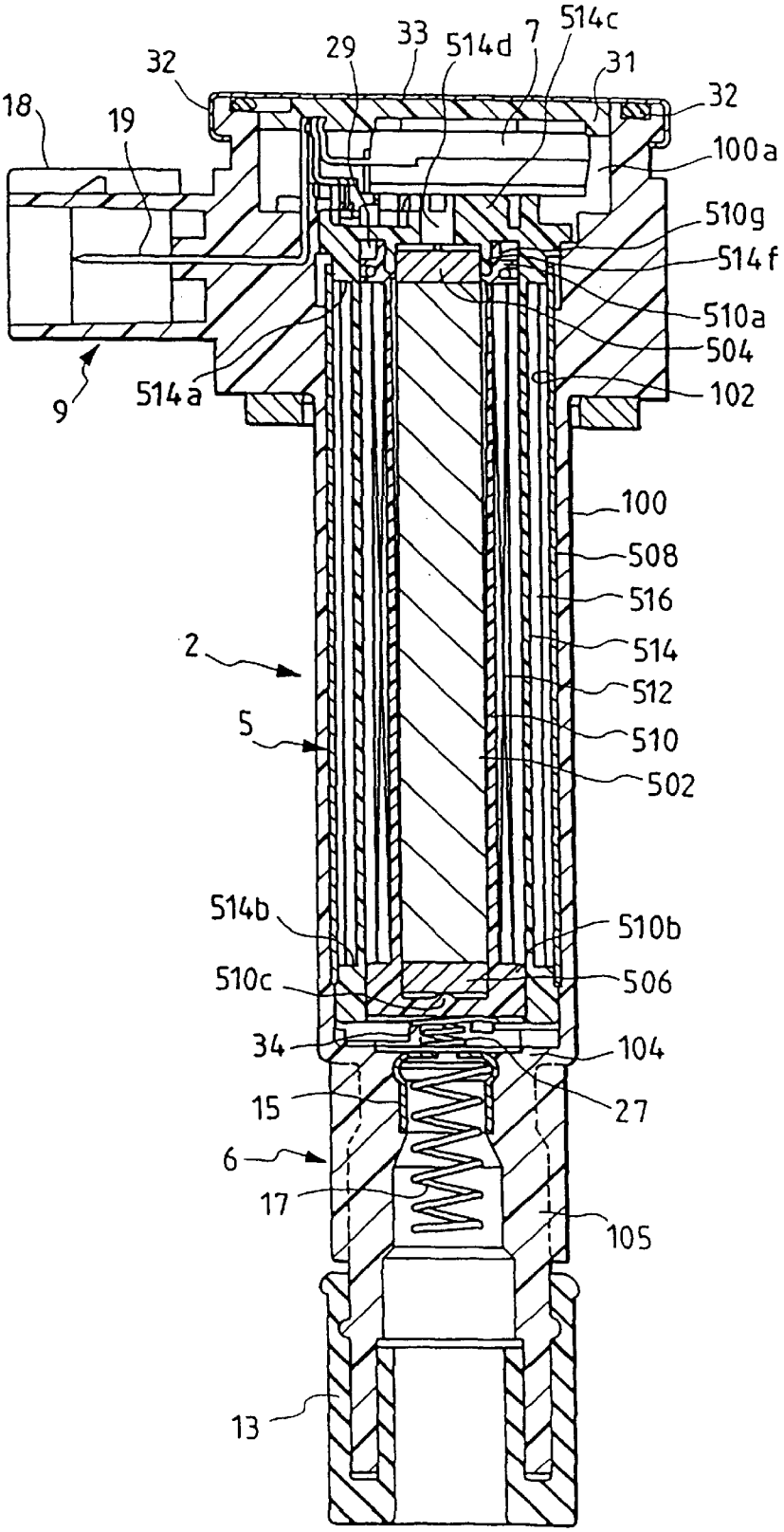
FIG. 2 is a cross sectional view which shows an ignition coil for an internal combustion engine using the electromagnetic coil in FIG. 1.

Referring now to the drawings, particularly to FIGS. 1 and 2, there is shown an ignition coil for an internal combustion engine according to the present invention. Note that embodiments, as discussed below, will refer to obliquely overlapped winding layers each consisting of turns of wire arranged uniformly, but, usually, a winding formed by an automatic winding machine has an inevitable yet allowable irregular turns.

The ignition coil 2, as shown in FIG. 2, generally includes a cylindrical transformer 5, a control circuit 7, and a connection 6. The control circuit 7 is disposed on an end of the transformer 5 and selectively turns on and off a primary current flowing through the transformer 5. The connection 6 is disposed on the other end of the transformer 5 and supplies a secondary voltage produced by the transformer 5 to a spark plug (not shown) installed in the engine.

The ignition coil 2 includes a cylindrical casing 100 made of a resin material. The cylindrical casing 100 defines a chamber 102 which has disposed therein the transformer 5 and is filled with an insulating oil 29 surrounding the transformer 5 and the control circuit 7. The cylindrical casing 100 also includes a control signal input connector 9 at an upper end of the chamber 102 and a bottom 104 at a lower end of the chamber 102. The bottom 104, as will be discussed later in detail, is closed by the bottom of a metallic cup 15. An outer peripheral wall of the cup 15 is surrounded by the connection 6 formed at the lower end of the casing 100.

The connection 6 has formed therein a hollow cylinder 105 for insertion of the spark plug. A rubber-made plug cap 13 is disposed on an end portion of the cylinder 105. The cup 15 is disposed within the bottom 104 of the casing 100 by means of the so-called insert moulding to establish liquid-tight sealing between the chamber 102 and the connection 6.

A compression coil spring 17 is retained by the bottom of the cup 15 for electric connection with an electrode of the spark plug inserted into the connection 6.

The connector 9 includes a connector housing 18 and three connector pins 19 (only one is shown for the brevity of illustration). The connector housing 18 is integrally formed with the casing 100. The connector pins 19 partially project into the connector housing 18 from the inside of the casing 100.

The casing 100 has formed in the upper end an opening 100*a* for mounting the transformer 5 and the control circuit 7 and injecting the insulating oil into the chamber 102 during assembly of the ignition coil 2. The opening 100*a* is closed by a metallic cover 33 which is tacked on the upper end of the casing 100. An O-ring 32 is disposed between the cover 33 and the end of the casing 100 for liquid-tight sealing.

The transformer 5 includes a cylindrical iron core 502, magnets 504 and 506, a secondary spool 510, a secondary winding 512, a primary spool 514, and a primary winding 516.

The iron core 502 is formed with thin silicon steel plates laminated in a circular form. The magnets 504 and 506 are attached to both ends of the iron core 502 using adhesive tape so as to have polarities producing magnetic flux in a direction opposite to that of magnetic flux produced under energization of the coil 2.

The secondary spool 510 is made of a resin material and includes, as shown in FIG. 1, a hollow winding cylinder 530, flanges 510*a* and 510*b* formed at both ends of the cylinder 530, and a bottom 510*c*.

A terminal plate 34 is disposed on the bottom 510*c* of the secondary spool 510 and electrically connected to a lead (not shown) extending from an end of the secondary winding 512. A spring 27 is mounted on the terminal plate 34 in engagement with the cup 15. The terminal plate 34 and the spring 27 work as a spool side conductor so that a high voltage developed across the secondary winding 512 is applied to the electrode of the spark plug through the terminal plate 34, the spring 27, the cup 15, and the spring 17.

A cylinder 510*g* is formed on an end of the secondary spool 510 opposite to the bottom 510*c* in a coaxial relation with the secondary spool 510. The secondary spool 510 has therein a chamber within which the iron core 502 and the magnet 506 are disposed. The secondary winding 512 is wound around the periphery of the winding cylinder 530 of the secondary spool 510 in a manner, as will be described later in detail. The primary spool 514 is formed with a hollow cylinder which has flanges 514*a* and 514*b* formed at both ends thereof and is closed at an upper end by a cover 514*c*. Wound around the periphery of the primary spool 514 is the primary winding 516.

The cover 514*c* of the primary spool 514 has formed thereon an annular portion 514*f* which extends downward as viewed in the drawing and is disposed within the cylinder 510*g* of the secondary spool 510 coaxially therewith. The cover 514*c* also has formed in the center thereof an opening 514*d*. Upon assembling of the primary spool 514 and the secondary spool 510, the iron core 502 having disposed on both ends thereof the magnets 504 and 506, is retained between the cover 514*c* of the primary spool 514 and the bottom 510*c* of the secondary spool 510.

An auxiliary core 508 is disposed around the primary winding 516 wound around the primary spool 514. The auxiliary core 508 is made of a cylindrical silicon steel plate rolled so as to form a gap or slit between both side edges thereof which extends from the periphery of the magnet 504 to the periphery of the magnet 506. This reduces a short-circuit current flowing in a circumferential direction of the auxiliary core 508.

The chamber 102 stores therein the insulating oil 29 with an air gap at the upper end portion thereof. The insulating oil 29 enters the lower opening of the primary spool 514, the opening 514*d* formed in the center of the cover 514*c* of the primary spool 514, the upper opening of the secondary spool 510, and given openings (not shown) to electrically insulate the iron core 502, the secondary winding 512, the primary winding 516, and the auxiliary core 508 from each other.

The secondary winding 512, as shown in FIG. 1, consists of wire 520 covered with an insulating film made of amide imide. The material of the insulating film may alternatively be urethane or polyester imide. The wire 520 is wound 16,000 times coaxially around the winding cylinder 530 of the secondary spool 510 in a slant direction relative to the length of the secondary spool 510 so that a plurality of winding layers are obliquely overlapped with each other. In other words, the wire 520 is wound around the winding cylinder 530 so that each of the winding layers defines a conical surface decreased in diameter as reaching from the flange 510*a* to the flange 510*b*. The reason that a total number of turns of the secondary winding 512 is 16,000 is because the secondary voltage determined by the turns ratio of the primary winding 516 to the secondary winding 512 requires 30 kV for producing an ignition arc at the spark plug. A maximum diameter of the wire 520 including the thickness of the insulating film is 0.07 mm. The length of the winding cylinder 530 in an axial direction thereof is 61.5 mm.

Figure 3:
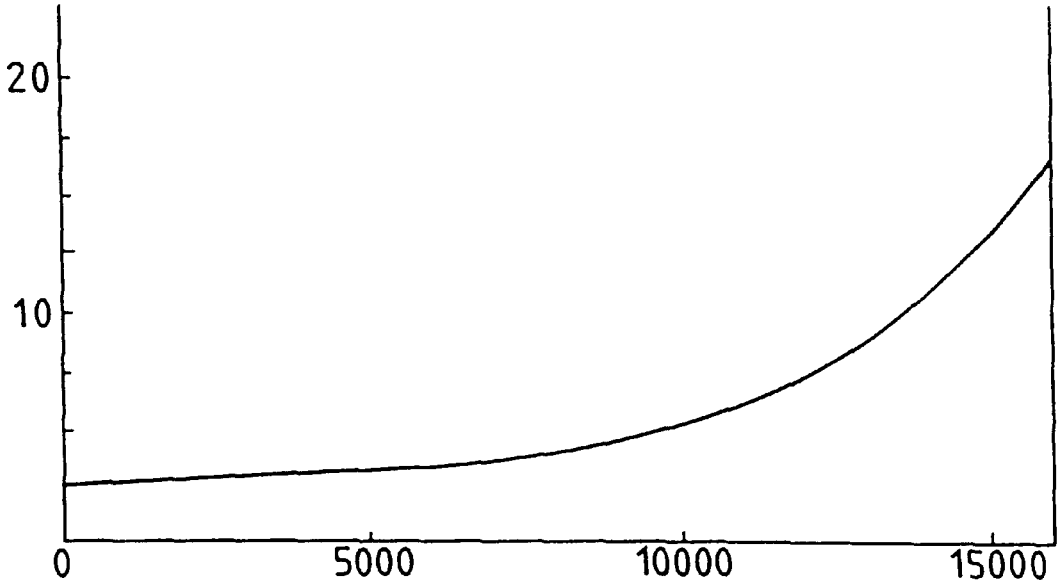
FIG. 3 is a graph which shows a potential distribution of a secondary winding of an electromagnetic coil.

The secondary winding 512 consists of three major portions: a first winding portion 531, a second winding portion 532, and a third winding portion 533. The first winding portion 531 consists of a collection of lower voltage winding layers overlapped in the form of a cone. Specifically, in a cross sectional view of FIG. 1, the first winding portion 531 corresponds to a right triangle defined by a leftmost outer winding turn 531 a close to an inner wall of the flange 510*a*, an innermost winding turn 531*b* of the same winding layer as the winding turn 531*a*, and a leftmost inner winding turn 531*c* close to a corner between the winding cylinder 530 and the flange 510*a*. Similarly, the third winding portion 532 consists of a collection of higher voltage winding layers in the form of a cone. Specifically, in FIG. 1, the third winding portion 532 corresponds to a triangle defined by a winding turn 521*b* close to a corner between the flange 510*b* and the winding cylinder 530, an uppermost winding turn 521*c* of the same winding layer as the turn 521*c*, and the inner wall of the flange 510*b*. The second winding portion 532 consists of a collection of middle voltage winding layers arranged between the first winding portion 531 and the third winding portion 533. The potential difference developed across one turn of the secondary winding 512 assumes a potential distribution as shown in FIG. 3. As apparent from the drawing, the first winding portion 531 including a leading portion of the wire 520 creates a potential difference of about 2.5 V every turn, and the potential difference every turn is increased as the number of turns is increased. The third winding portion 533 including a trailing portion of the wire 520 creates a potential difference of 15 V to 16 V. Specifically, a boundary portion between the second winding portion 532 and the third winding portion 533 develop the high voltage. The potential difference appearing across adjacent two of turns of the secondary winding 512, for example, the turn 521*a* and the turn 521*b* arranged in the lengthwise direction of the secondary spool 510 may be determined using the potential distribution in FIG. 3 and the number of turns of the wire 520 over adjacent winding layers 522 ranging from the turn 521*a* to the turn 521*b*. Specifically, the potential difference appearing across the turns 512*a* and 512*b* may be determined by multiplying the potential difference V developed across one turn, as derived from FIG. 3, by the number of turns n of the wire 520 over the adjacent winding layers 522 (i.e., V×n).

An upper limit of the number of turns $t_H$ of adjacent two of the winding layers of the secondary winding 512 showing a maximum potential difference in the potential distribution of the secondary winding 512 may be expressed by the following equation.

$$t_H \leqq n_T / V_{OUT} \times 180 \quad (1)$$

where $n_T$ is a total number of turns of the secondary winding 512 and $V_{OUT}$ is the voltage outputted by the secondary winding 512.

From the equation (1), the number of turns $t_H$ of the adjacent winding layers 522 creating a maximum potential difference in the potential distribution of the secondary winding 512 will be less than or equal to about 96 since $n_T$=16,000 and $V_{OUT}$=30 kV. Thus, a maximum potential difference Vmax developed across the adjacent winding layers 522 is 16(V)×96=1,536(V). Specifically, the number of turns $t_H$ of the adjacent winding layers 522 is set to a value determined by the above equation (1) so that the potential difference appearing across the turns 521*a* and 521*b* shows about 1.5 kV. The reasons for this may be summarized according to three points below.

(1) Usually, the dielectric strength of amide imide used as the insulating film of the wire 520 is 3.0 V to 4.0 V in terms of a.c. voltage, while it is 6.5 V to 8.0 V in terms of d.c. voltage. For example, if the insulating film made of amide imide is subjected to intense heat of 150° C. for 2000 hours, it will cause the dielectric strength thereof to be decreased to about 70%. Specifically, when the ignition coil 2 is used in an internal combustion engine, the dielectric strength of the insulating film is decreased to about 4.5 kV to 5.5 kV in terms of d.c. voltage.

(2) The winding layers may be shifted or the arrangement of winding turns may be disordered during winding of the wire 520 around the secondary spool 514. For example, if a maximum diameter of the wire 520 is 0.05 mm to 0.08 mm, a winding pitch $P_1$, as shown in FIG. 1, is two to four times the diameter of the wire 520, test results derived by the inventors of this invention showed that it was necessary to provide a safety factor of more than about three times the potential difference developed across adjacent two of the winding layers in view of the shifting of the winding layers and the disorder of the arrangement of the winding turns.

(3) Having regard to the safety factor as discussed above, the dielectric strength of the wire 520, which would be decreased to about 4.5 kV to 5.5 kV when it is used under environmental conditions as mentioned above, needs to be considered as being decreased to about 1.5 kV which is one-third of 4.5 kV. It will thus be appreciated that the dielectric strength between the winding turns 521*a* and 521*b* of the adjacent winding layers 522 showing the maximum potential difference in the third winding portion 533 of the secondary winding 512 is about 1.5 kV. Thus, it is advisable that the number of turns of the adjacent winding layers 522 be so determined that the potential difference Vmax appearing across the adjacent winding layers shows about 1.5 kV.

Therefore, in this embodiment, the wire 520 is wound in the third winding portion 533 so that a maximum number of turns, that is, the number of turns of the adjacent winding layers 522 is less than or equal to the number of turns $t_H$ determined by the equation (1), and the remaining winding layers are decreased in diameter as the flange 510*b* (i.e., the end of the secondary winding 512) is reached. The height of the adjacent winding layers 522 from the outer surface of the winding cylinder 530 in a radial direction of the third winding portion 533 is determined by the angle θ at which the winding layers are oriented to the periphery of the winding cylinder 530 and the number of turns $t_H$.

The first winding portion 531 has a uniform height in a radial direction thereof which is established by setting the number of turns of adjacent two of the winding layers to a constant value. The second winding portion 532 between the first winding portion 531 and the third winding portion 533 has a tapered profile which is defined by winding the wire 520 so that outermost winding turns lie along a line extending from an outermost winding turn of the first winding portion 513 adjacent to the second winding portion 532 to an outermost winding turn of the third winding portion 533 adjacent to the second winding portion 532. In other words, the diameter of the second winding portion 532 is decreased at a given rate from the first winding portion 531 to the third winding portion 533. The number of turns of adjacent two of the winding layers in each of the second and third winding portions 532 and 533 will be greater than 96 when the number of turns of the adjacent winding layers 522 of the third winding portion 533 is set to a maximum number of turns (i.e., 96) determined by the equation (1), but all of the winding portions 531, 532, and 533 may alternatively be less than 96 in number of turns of adjacent two of the winding layers.

The beneficial results in a winding process produced by locating the third winding portion 533 close to the flange 510*b* will be discussed below.

In a turning point of the wire 520 on the periphery of the secondary spool 510, that is, a turning point from an innermost winding turn of the winding layer 520*a*, as indicated by black circles in FIG. 1, to an innermost winding turn of the winding layer 520*b*, as indicated by white circles, a tensile force produced inward in the radial direction of the third winding portion 533 and a sliding force produced when the wire 520 is being wound obliquely in an inward direction will act on the wire 520, thereby causing the wire 520 to be shifted in an advancing direction, but these forces are absorbed by the flange 510*b*, preventing the wire 520 from being disordered. The same is true for a turning point from an innermost winding turn of the winding layer 520*a* to an innermost winding turn of the winding layer 520*b*.

According to the above first embodiment, a margin for degradation in dielectric strength of the insulating film of the wire 520 caused by use under high temperature environmental conditions is produced by setting the number of turns of the adjacent winding layers 522 developing the highest potential difference in the third winding portion 533 of the secondary winding 512 to a value less than or equal to a maximum value (i.e., 96) determined by the above equation (1). Specifically, this provides a safety factor of three times the degradation in dielectric strength of the insulating film of the wire 520 caused by the shifting of the wire 520 or disorder thereof, thereby establishing a sufficient dielectric strength of the wire 520 having a maximum diameter of 0.07 mm in use of the ignition coil 2 in an internal combustion engine.

Additionally, the number of turns is increased gradually from the third winding portion 533 to the first winding portion 531. The performance of the ignition coil 2 is thus enhanced greatly as compared with when the number of turns of each of the first and second winding portions 531 and 532 is equal to that of the third winding portion 533.

While, in the above embodiment, the output voltage $V_{out}$ of the secondary winding 520 is 30 kV, and the total number of turns $t_r$ of the secondary winding 520 is 16,000, only the output voltage $V_{out}$ may be changed to 35 kV. In this case, the number of turns $t_H$ of the adjacent winding layers 522 developing the highest potential difference in the secondary winding 512 is given by an equation below.

$$t_H \leqq n_T / V_{OUT} \times 155 \quad (2)$$

In order to further improve dielectric withstanding ability of the ignition coil 2, the following equation may alternatively be used.

$$t_H \leqq n_T / V_{OUT} \times 100 \quad (3)$$

The equation (3) allows, for example, inexpensive urethane resin whose dielectric strength is smaller than that of polyamide imide to be used as the insulating film of the wire 520, thereby resulting in decreased manufacturing costs of the ignition coil 2.

The dielectric withstanding ability of the secondary winding 512 may further be improved by decreasing a constant in the above equations, but the decrease in constant will cause the space factor of the secondary winding 512 to be decreased. Specifically, in order to obtain a given number of turns of the secondary winding 512 with a decreased space factor, it is necessary to prolong an axial length of the secondary spool 510. This increases the overall length of the ignition coil 2. It is therefore advisable that a lower limit of the constant in the above equations be determined in view of installation of the ignition coil 2 in a plug hole of an engine block. For instance, when the lower limit of the constant is 40, it provides an appropriate safety factor of the dielectric withstanding ability to the secondary winding 512, but it becomes difficult to install the ignition coil 2 in the engine for an increased size thereof.

Figure 4:
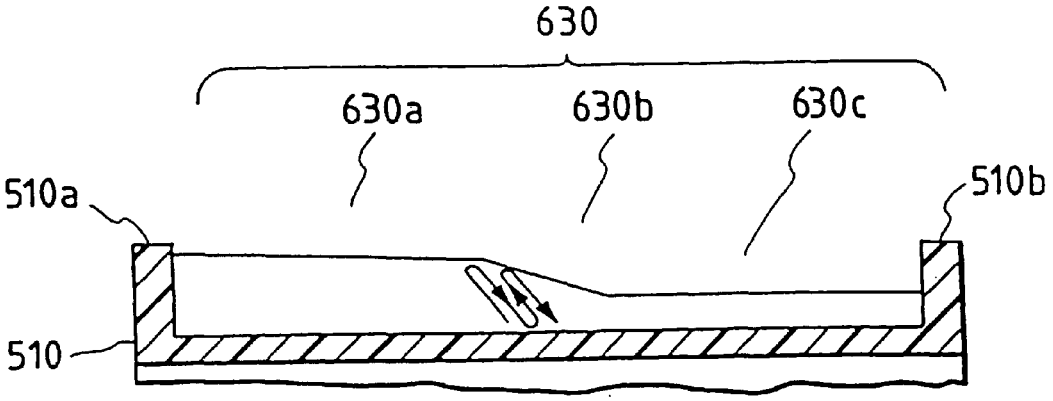
FIG. 4 is a partially sectional view which shows a secondary winding according to the second embodiment of the invention.

FIG. 4 shows the second embodiment of the secondary winding. The same reference numbers as employed in the above embodiments refer to the same parts, and explanation thereof in detail will be omitted here.

In this embodiment, the number of turns of adjacent two of winding layers creating the highest potential difference in the secondary winding 630 is determined by the above equation (1). The wire 520 is wound obliquely around the secondary spool 510 in the same manner as in the first embodiment. The secondary winding 630 consists of first, second, and third winding portions 630*a*, 630*b*, and 630*c*. The first and the third winding portions 630*a* and 6530*c* have uniform diameters, respectively. The second winding portion 630*b* is decreased in number of turns at a constant rate from the first winding portion 630*a* to the third winding portion 630*c*. Specifically, the second winding portion 630*b* is of a tapered or conical shape.

In the second embodiment, the length of the tapered second winding portion 630*b* is shorter than a total length of the tapered winding portions 532 and 533 of first embodiment, thereby allowing an operational control program of an automatic winding machine to be simplified.

Figure 5:
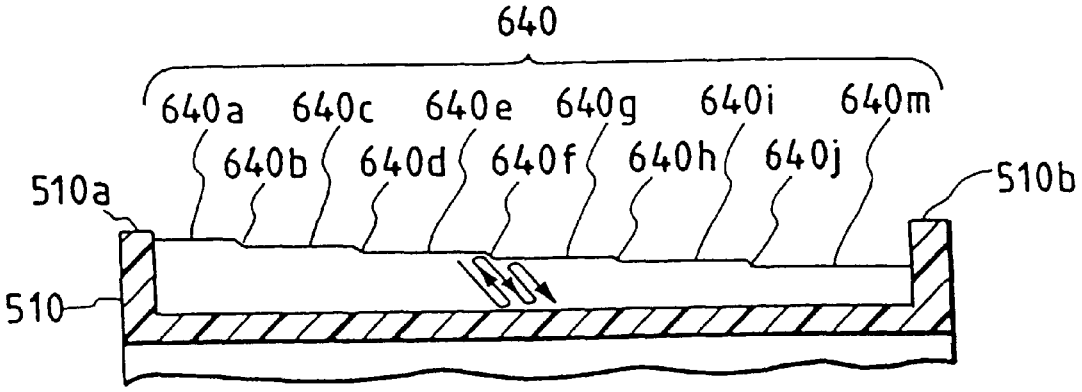
FIG. 5 is a partially sectional view which shows a secondary winding according to the third embodiment of the invention.

FIG. 5 shows the third embodiment of the secondary winding. The same reference numbers as employed in the above embodiments refer to the same parts, and explanation thereof in detail will be omitted here.

The secondary winding 640, as can be seen from the drawing, includes six stepped windings 640*a*, 640*c*, 640*e*, 640*g*, 640*i*, and 640*m* and five tapered connection windings 640*b*, 640*d*, 640*f*, 640*h*, and 640*j*. Each of the stepped windings 640*a* to 640 m has a constant diameter.

The number of turns of adjacent two of winding layers creating the highest potential difference in the secondary winding 640 (i.e., adjacent winding layers extending from the periphery of the stepped winding 640 m to a corner between the flange 510*b* and the outer surface of the winding cylinder 530) is determined by the above equation (1). The other stepped windings 640*a* to 640*i* are increased in diameter (i.e, the number of turns) in a stepwise fashion as reaching the flange 510*a* (i.e., the lower voltage side). The connection windings 640*b* to 640*j* connect adjacent two of the stepped windings 640*a* to 640*m*, respectively.

The above structure of the secondary winding 640 increases the space factor thereof as compared with the second embodiment. This allows the number of turns of each of the primary winding 516 (see FIG. 2) and the secondary winding 640 to be increased for increasing the output voltage of the secondary winding 640.

Figure 6:
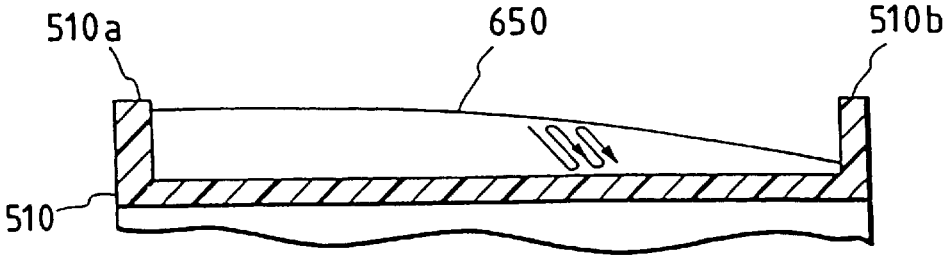
FIG. 6 is a partially sectional view which shows a secondary winding according to the fourth embodiment of the invention.

FIG. 6 shows the fourth embodiment of the secondary winding. The same reference numbers as employed in the above embodiments refer to the same parts, and explanation thereof in detail will be omitted here.

The secondary winding 650 is decreased in diameter (i.e., the number of turns) at a varying rate from the flange 510*a* to the flange 510*b* so as to present a curved profile which is tapered at a rate increasing as the flange 510*b* is reached. Specifically, the number of turns of adjacent two of all winding layers is determined according to the equation (1) using the potential difference developed across one turn every number of turns, as shown in FIG. 3. This structure improves the space factor of the secondary winding 650 while optimizing the dielectric withstanding ability thereof.

Figure 7:
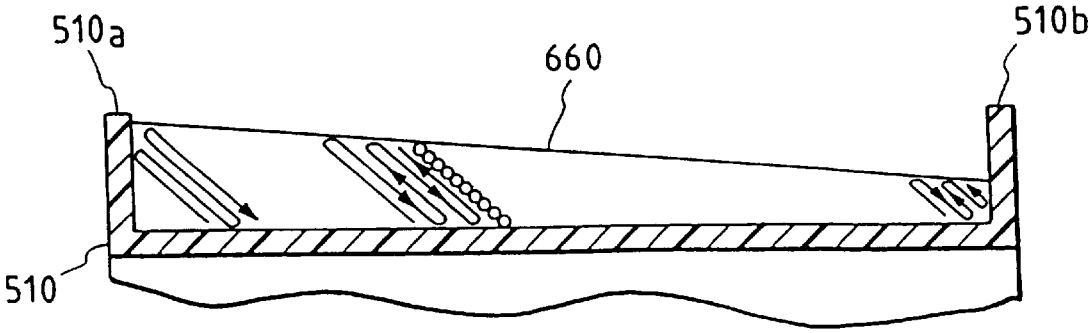
FIG. 7 is a partially sectional view which shows a secondary winding according to the sixth embodiment of the invention.

FIG. 7 shows the fifth embodiment of the secondary winding. The same reference numbers as employed in the above embodiments refer to the same parts, and explanation thereof in detail will be omitted here.

The secondary winding 660 is increased in diameter (i.e., the number of turns) at a constant rate from the flange 510*a* to the flange 510*b* to assume a frusto-conical profile. The number of turns of adjacent two of winding layers creating the highest potential difference in the secondary winding 660 is determined by the above equation (1).

Figure 8:
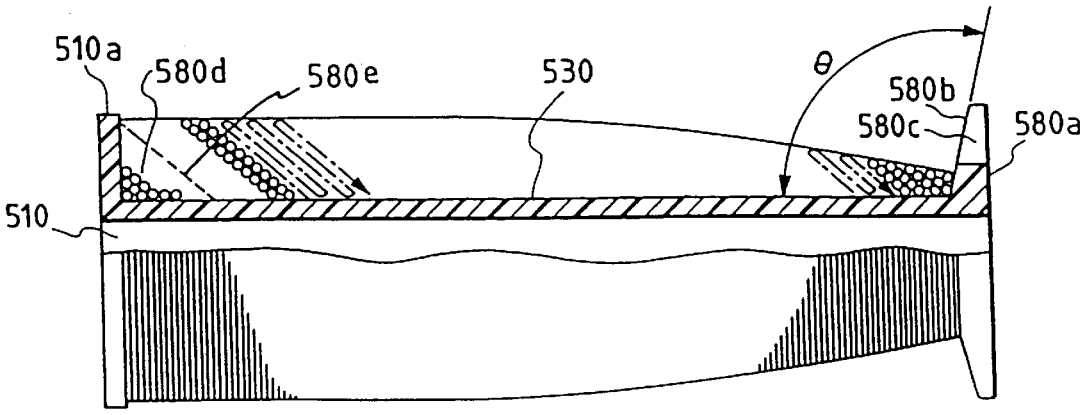
FIG. 8 is a sectional view which shows a secondary winding according to the sixth embodiment of the invention.

FIG. 8 shows the sixth embodiment of the secondary winding which presents substantially the same profile as that in the first embodiment, but is different therefrom in shape of the secondary spool 510 and in that a winding arrangement of turns of a trailing portion of the wire 520 is more regular than that of a leading portion of the wire 520 in a coaxial direction. The same reference numbers as employed in the above embodiments refer to the same parts, and explanation thereof in detail will be omitted here.

The winding cylinder 530 of the secondary spool 510 extends straight along the longitudinal center line of the secondary spool 510 without any partitions. The secondary spool 510 has the flanges 510*a* and 580*a* at both ends thereof. The flange 580*a* is located on the winding end side and has a flared or conical inner surface 580*b* oriented at a given obtuse angle of θ to the periphery of the winding cylinder 530 (i.e., the longitudinal center line of the secondary spool 510). The conical shape of the flange 580*a* serves to prevent winding turns made of the trailing portion of the wire 520 from being disordered. Usually, a gap may be formed in a winding end portion due to variations in length of a spool and in tensile force acting on a wire during a winding process. The conical surface 580*b* of the flange 580*a* alleviates this problem. Specifically, the conical surface of the flange 580*a* serves to hold an arrangement of turns of a high voltage winding portion adjacent to the flange 580*a*, thereby assuring high insulation thereof.

The flange 580*a* has formed therein a groove 580*c* for withdrawing the trailing portion of the wire 50 outside the secondary spool 510. The groove 580*c* extends from an edge of the flange 580*a* to a location above an outermost turn of the wire 520 close to the conical surface 580*b* for preventing turns of the wire 520 close to the flange 580*a* from being pushed out of the secondary spool 510. This avoids shifting of the winding layers of the secondary winding 512.

An inclined surface 580*e* is defined as a reference surface for slant winding of the wire 50 by an irregular winding portion 580*d* which is formed by an automatic winding machine. The irregular winding portion 580*d* is of a triangular shape in cross section defined by an outer surface of the winding cylinder 530 and an inner surface of the flange 510*a* and consists of a collection of turns wound irregularly. The inclined surface 580*e* thus facilitates easy winding of the wire 520 in the slant direction throughout the length of the secondary spool 510.

The left end portion, as viewed in the drawing, of the secondary winding 512 is designed so as to create lower voltage through the ignition coil 2 similar to the above embodiments. Specifically, a leading edge of the irregular winding portion 580*d* is connected to a power source (i.e., 12 V) for the ignition coil 2. Thus, a potential difference developed across the irregular winding portion 580*d* is relatively low, thereby preventing dielectric withstanding and insulating abilities of the secondary winding 512 from being degraded greatly.

Figure 9:
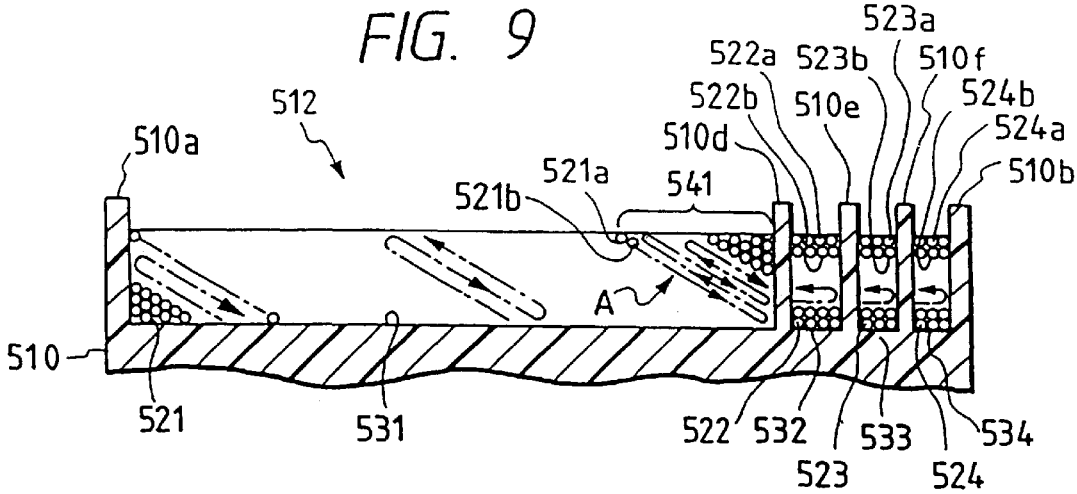
FIG. 9 is a partially sectional view which shows a secondary winding according to the seventh embodiment of the invention.
Figure 10:
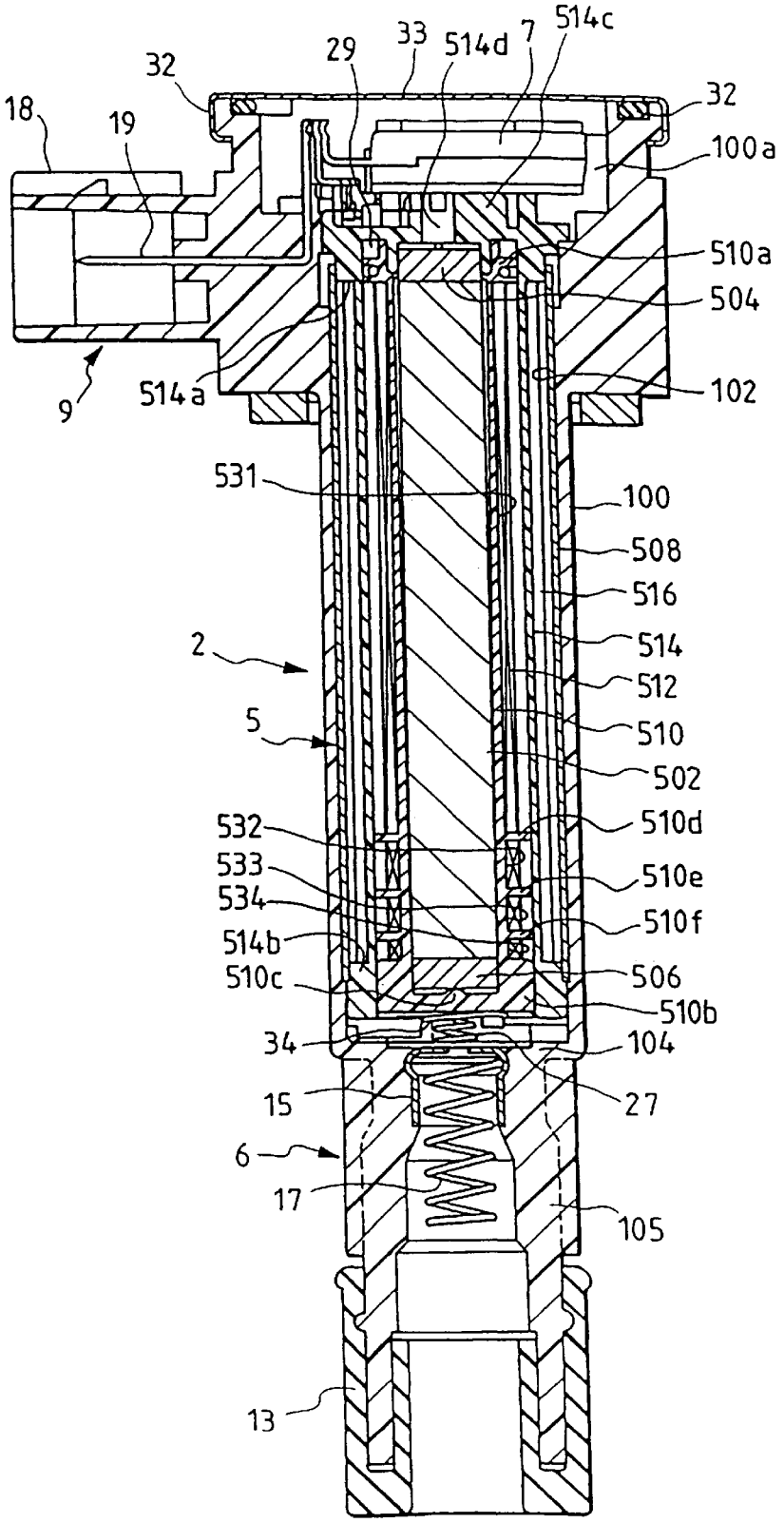
FIG. 10 is a cross sectional view which shows an ignition coil for an internal combustion engine using the electromagnetic coil in FIG. 9.

FIGS. 9 and 10 show the seventh embodiment of the ignition coil 2 which is different from the above embodiments in shape of the secondary spool 510 and winding arrangement. The same reference numbers as employed in the above embodiments refer to the same parts, and explanation thereof in detail will be omitted here.

Figure 11:
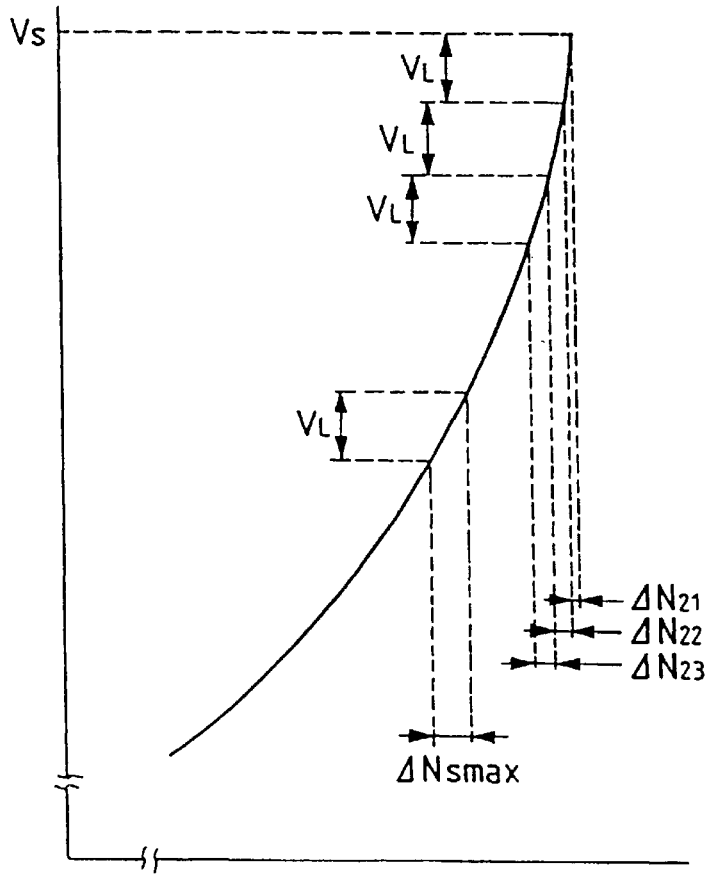
FIG. 11 is a graph which shows the relation between the number of turns of a high voltage winding and an output voltage of the high voltage winding.

The secondary spool 510 is made of a resin material and includes the flanges 510*a* and 510*b* at both ends. The secondary spool 510 is, as can be seen in FIG. 11, toothed or slotted to form partitions 510*d*, 510*e*, and 510*f* on a high voltage side between the flanges 510*a* and 510*b*. The secondary winding 512 includes a first winding section consisting of a lower voltage winding portion 531 and a second winding section consisting of three higher voltage winding portions: a first higher voltage winding portion 532 between the partitions 510*d* and 510*e*, a second higher voltage winding portion 533 between the partitions 510*e* and 510*f*, and a third higher voltage winding portion 534 between the partition 510*f* and the flange 510*b*. The lower voltage winding portion 531 is disposed over a wider range from the flange 510*a* to the partition 510*d*. The length of each of the higher voltage winding portions 532, 533, and 534 in the lengthwise direction of the secondary spool 510 is shorter than that of the lower voltage winding portion 531.

The locations of the partitions 510*d*, 510*e*, and 510*f*, as will be discussed in detail, depend upon a potential distribution of the secondary winding 512. Specifically, since in the potential distribution of the secondary winding 512 shown in FIG. 3, a secondary voltage appearing across the secondary winding 512 is increased as the number of turns of the secondary winding 512 is increased, the partition 510*d* is formed at a location where the number of turns of the secondary winding 512 reaches a given value.

The secondary winding 512, like the above embodiments, consists of a wire covered with the insulating film made of amide imide, wound around the secondary spool 510 a given number of times.

The lower voltage winding portion 531 includes a plurality of winding layers obliquely overlapped with each other which consist of part of an overall length of a wire 521 and are oriented obliquely with respect to the longitudinal center line of the secondary spool 510. The higher voltage winding portions 532, 533, and 534 consist of the remainder of the wire 521 which is indicated by reference numbers 522, 523, and 524 in FIG. 9. The wires 522, 523, and 524 are, as clearly shown in FIG. 9, wound in the lengthwise direction of the secondary spool 510, respectively, so as to form a plurality of winding layers overlapped horizontally.

The reason that only the higher voltage winding section of the secondary winding 512 is separated into a plurality of winding portions (i.e., the higher voltage winding portions 532, 533, and 534) in a slotting winding manner is because an improved dielectric withstanding properties is provided by the slotting winding manner, and a high density arrangement of the wire 520 is achieved by the obliquely overlapped winding layers of the lower voltage winding portion 531.

The locations of the partitions 510*d*, 510*e*, and 510*f* on the secondary spool 510 will be discussed below.

The voltage appearing across the secondary winding 512, as shown in FIG. 3, is increased as the number of turns of the secondary winding 512 is increased. The increase in number of turns of the secondary winding 512 will cause a slope of the voltage curve to be increased in FIG. 3. In other words, the voltage appearing across adjacent two turns of the wire 520 wound around the secondary winding 512 shown in FIG. 1 is increased gradually as the higher voltage side of the secondary winding 512 is reached.

Specifically, in the lower voltage winding portion 531 consisting of the obliquely overlapped winding layers, the highest potential difference is developed across a winding layer 521*a* and a following winding layer 521*b*, as shown in FIG. 9. The winding layer 521*a* extends from the periphery of the secondary winding 512 to a corner between the inner wall of the partition 510*d* and the outer wall of the winding cylinder 530 and corresponds to a hypotenuse, as indicated by a character A, of a right triangle in cross section defined by the inner wall of the partition 510*d* and the outer surface of the secondary winding 512. It is thus necessary to determine the number of turns of the adjacent winding layers 521*a* and 521*b* so that the highest potential difference between the winding layers 521*a* and 521*b* is less than the breakdown voltage VL. Note that the breakdown voltage VL is a minimum voltage causing adjacent two of turns of wire covered with an insulating film from being short-circuited, which is determined by a type of material of the insulating film.

Using the breakdown voltage VL, the number of turns $\Delta N_{smax}$ of the adjacent winding layers 521*a* and 521*b* of the lower voltage winding portion 531 may be determined according to the relation, as shown in FIG. 11, between an output voltage of the secondary winding 512 and the number of turns of the secondary winding 512. The number of turns $\Delta N_{smax}$ determined from FIG. 13 allows for disorder of wire arrangement caused by the obliquely overlapping winding. The determination of the number of turns $\Delta N_{smax}$ allows locations of the adjacent winding layers 521*a* and 521*b* to be determined, thereby allowing the location of the partition 512*d* to be determined. Specifically, the partition 512*d* may be located on the high voltage side from the adjacent winding layers 521*a* and 521*b*. Other winding layers of the lower voltage winding portion 531 may be designed so that the number of turns of adjacent two of the winding layers is lower than the number of turns $\Delta N_{smax}$ since the potential difference between adjacent two of the winding layers is lower than that between the adjacent winding layers 521*a* and 521*b*.

The location of the partition 510*e* on the secondary spool 510 is determined in the following manner.

The number of turns $\Delta N_{23}$, as shown in FIG. 11, indicates the number of turns of an uppermost winding layer 522*a* and the immediately following winding layer 522*b* disposed inside the winding layer 522*a* across which the highest potential difference appears in the first higher voltage winding portion 532 when the potential difference between the winding layers 522*a* and 522*b* reaches the breakdown voltage VL. Specifically, half of the number of turns $\Delta N_{23}$ corresponds to the number of turns of one winding layer ranging from the partition 510*d* to the partition 510*e*. Therefore, the partition 510*e* is formed at a location away from the partition 510*d* at a distance corresponding to a value of $\Delta N_{23}/2$.

Similarly, the number of turns $\Delta N_{22}$, as shown in FIG. 11, indicates the number of turns of an uppermost winding layer 523*a* and the immediately following winding layer 523*b* disposed inside the winding layer 523*a* across which the highest potential difference appears in the second higher voltage winding portion 533 when the potential difference between the winding layers 523*a* and 523*b* reaches the breakdown voltage VL. Thus, the partition 510*f* is, similar to the above, formed at a location away from the partition 510*e* at a distance corresponding to a value of $\Delta N_{22}/2$.

The location of the flange 510*b* is also determined in the same manner as described above. Specifically, the number of turns $\Delta N_{21}$, as shown in FIG. 11, indicates the number of turns of an uppermost winding layer 524*a* and the immediately following winding layer 524*b* disposed inside the winding layer 524*a* across which the highest potential difference appears in the third higher voltage winding portion 534 when the potential difference between the winding layers 524*a* and 524*b* reaches the breakdown voltage VL. Thus, the flange 510*b* is formed at a location away from the partition 510*f* at a distance corresponding to a value of $\Delta N_{21}/2$.

As apparent from the above discussion, the seventh embodiment has formed only on the higher voltage side of the secondary winding 512 the slot windings (i.e., the higher voltage winding portions 532, 533, and 534) which are capable of enhancing the dielectric withstanding voltage and insulation performance. This arrangement thus compensates for a lack of the dielectric withstanding voltage and insulation performance of the lower voltage winding portion 531 consisting of the obliquely overlapped winding layers which are apt to crumble.

While the present invention has been disclosed in terms of the preferred embodiment in order to facilitate a better understanding thereof, it should be appreciated that the invention can be embodied in various ways without departing from the principle of the invention. Therefore, the invention should be understood to include all possible embodiments and modification to the shown embodiments which can be embodied without departing from the principle of the invention as set forth in the appended claims.

For example, the winding direction of each winding layer of the secondary winding in the above embodiments is reversed between adjacent two of the winding layers, however, it may be oriented in the same direction (i.e., one of inward and outward directions). Additionally, the wire is wound from the periphery of the secondary winding to the outer surface of the secondary spool and vice versa in the above embodiments, however, it may be returned from the middle of an adjacent winding layer. In other words, the number of turns of one winding layer may be decreased alternately.

What is claimed is:

1. An electromagnetic coil, comprising:

a spool with first and second ends defining a predetermined length therebetween;

a wire wound around a surface of said spool between said first and second ends of said spool so that a winding is formed around said spool, said winding including a plurality of winding layers overlapped with each other and inclined at a predetermined angle to the surface of said spool, wherein said winding has a first part in which the distance from an exterior surface of said winding to the surface of said spool is constant and a second part in which the distance is gradually decreased toward the second end from the first end.

2. An electromagnetic coil as set forth in claim 1, wherein the number of turns in the winding layer of said winding on a second end side is smaller than the number of turns in the winding layer of said winding on a first end side.

3. An electromagnetic coil as set forth in claim 1, wherein the distance of the second part decreases at a predetermined rate.

4. An electromagnetic coil as set forth in claim 1, wherein the distance decreases in a step-wise fashion by alternatively and repeatedly forming the first part and the second part.

5. An electromagnetic coil as set forth in claim 1, wherein the distance of the second part decreases in a curved fashion.

6. A winding for en electromagnetic coil, comprising:

first and second ends defining a length therebetween;

interior and exterior surfaces defining a diameter of the winding, measured as a distance between the interior and exterior surfaces;

a first winding portion formed on a first end side, having a first length, including a plurality of winding layers overlapped with each other and inclined at a predetermined angle to the first length; and a second winding portion formed on a second side, having a second length, including a plurality of winding layers overlapped with each other and inclined at a predetermined angle to the second length, wherein the diameter of the first winding portion is constant and the second winding portion includes a part in which the diameter is gradually decreased toward the second end.

7. A winding for an electromagnetic coil as set forth in claim 6, wherein the number of turns of each of the winding layers of the second winding portion which is closer to the second end than the diameter-decreasing part is smaller that he number of turns of each of the winding layers of the first winding portion.

8. A winding for an electromagnetic coil as set forth in claim 6, wherein the diameter of the diameter-decreasing part decreases at a predetermined rate.

9. A winding for an electromagnetic coil as set forth in claim 6, wherein the diameter of the diameter-decreasing part decreases in a curved fashion.

10. An electromagnetic coil used for a secondary winding of an ignition coil for an internal combustion engine, comprising:

a spool with first and second ends;

a wire wound around a surface of said spool between first and second ends of said spool so that a winding is formed around said spool, wherein said winding includes a plurality of winding layers overlapped with each other and inclined at a predetermined angle to the surface of said spool so that one end of each winding layer is in contact with the surface of said spool and another end of each winding layer forms an exterior surface of the winding, and one end of said wire on a side of said second end of said spool is connected to a spark plug of said internal combustion engine, wherein a number of turns of each of said winding layers is decreased as approaching from said first end of said spool to said second end of said spool.

* * * * *